US005807154A

United States Patent [19]

Watkins

[11] Patent Number: 5,807,154

[45] Date of Patent: Sep. 15, 1998

[54] PROCESS FOR ALIGNING AND SEALING FIELD EMISSION DISPLAYS

[75] Inventor: Charles M. Watkins, Meridian, Id.

[73] Assignee: Micron Display Technology, Inc., Boise, Id.

[21] Appl. No.: 576,672

[22] Filed: Dec. 21, 1995

[51] Int. Cl.[6] ..... H01J 9/26

[52] U.S. Cl. ..... 445/25; 445/43; 445/44; 65/43

[58] Field of Search ..... 445/25, 43, 44; 156/319; 65/43, 58

[56] References Cited

U.S. PATENT DOCUMENTS

| | | | |
|---|---|---|---|
| 4,005,920 | 2/1977 | Wimmer | 316/19 |
| 4,245,273 | 1/1981 | Feinberg et al. | 361/382 |
| 4,277,275 | 7/1981 | Kawamura et al. | 65/43 |
| 4,417,296 | 11/1983 | Schelhorn | 361/386 |
| 4,665,468 | 5/1987 | Dohya | 361/414 |
| 4,795,670 | 1/1989 | Nishigaki et al. | 428/209 |
| 5,205,770 | 4/1993 | Lowrey et al. | 445/24 |
| 5,210,472 | 5/1993 | Casper et al. | 315/349 |
| 5,229,331 | 7/1993 | Doan et al. | 437/228 |
| 5,302,238 | 4/1994 | Roe et al. | 156/643 |
| 5,329,207 | 7/1994 | Cathey et al. | 315/169.1 |
| 5,391,259 | 2/1995 | Cathey et al. | 156/643 |
| 5,519,332 | 5/1996 | Wood et al. | 324/755 |

FOREIGN PATENT DOCUMENTS

| | | | |
|---|---|---|---|
| 53-141572 | 12/1978 | Japan | 445/25 |
| 2-129828 | 5/1990 | Japan | 445/44 |
| 1533395 | 11/1978 | United Kingdom | 445/25 |

OTHER PUBLICATIONS

Liu, D. et al., "Characterization of Gated Silicon Field Emission Micro Troides", Sixth International Vacuum Microelectronics Conference, IEEE, Electron Devices Society, Technical Digest, Jul., 1993, pp. 52, 53.

Leppo, Marion et al., *Electronic Materials Handbook*, vol. 1 Packaging, 1989, pp. 203–205.

Kishino, Takao et al., "Present Status of the FED Development and Problems to Solve", Technical Paper, IVMC Futaba Corporation, Japan, 1995.

Meyer, R., "6" Diagonal Microtips Fluorescent Display for T.V. Applications, LETI/DOPT CENG, Euro display 1990, pp. 374–377.

Vaudaine, R., "Microtips' Fluorescent Display", IEDM, 1991.

Glass Panel Alignment and Sealing for Flat Panel Displays, Sandia National Laboratory, Colorado, Program Summary, Dec. 1994.

Zimmerman, Steven et al., Flat Panel Display Project Presentation, Sandia National Laboratories, Technical Information Exchange Workshop, Nov. 30, 1994

Tummala, Rao R., *Microelectronics Packaging Handbook*, pp. 736–755, 1989.

Cathey, David A. Jr., "Field Emission Displays", VLSI, Taiwan, May–Jun., 1995.

*Primary Examiner*—P. Austin Bradley
*Assistant Examiner*—Jeffrey T. Knapp
*Attorney, Agent, or Firm*—Hale and Dorr LLP

[57] ABSTRACT

According to two aspects of the invention, a FED and a process for making a FED are provided which effectuate more accurate and efficient sealing between a faceplate and a backplate assembly, with more accurate and efficient sealing between the faceplate and cathode member. The FED is made according to a process including: aligning the faceplate and the cathode member; disposing an adhesive between the faceplate and the cathode member; pressing the faceplate and the cathode member together; disposing a frit seal between the faceplate and the backplate assembly; and heating the frit seal to a temperature sufficient to cause the frit to seal.

34 Claims, 1 Drawing Sheet

PROCESS FOR ALIGNING AND SEALING FIELD EMISSION DISPLAYS

BACKGROUND OF THE INVENTION

This invention relates generally to flat panel field emission displays and more particularly to methods of manufacturing field emission displays.

Field emission displays ("FEDs") are flat panel displays comprising faceplates on which phosphor pixels reside and cathode members having micro-tip cathodes which emit electrons to activate the phosphors. In some embodiments, the cathode member is attached to or integrally formed with a backplate, and in other embodiments, the cathode member is attached to the faceplate and surrounded by a separate backplate. In either case, the cathode member must be aligned with the faceplate so that the cathode tips are in opposed relation to the specific pixels which they are intended to activate. Also, because the display must operate in a vacuum (for example, $10^{-6}$ Torr), a seal must be made between the backplate and the faceplate. Maintaining alignment while making the seal in high resolution displays and in large area displays is a very serious problem.

It is an object of the present invention to provide a method for making a FED whereby alignment of the cathode member and sealing of the backplate are accomplished in a manner which achieves more accuracy and efficiency than before.

SUMMARY OF THE INVENTION

The above object is addressed, according to one aspect of the invention, by a FED comprising a faceplate and a cathode member, made according to a process comprising: aligning the faceplate and the cathode member; disposing an adhesive between the faceplate and the cathode member; pressing the faceplate and the cathode member together; disposing a frit seal between the faceplate and a backplate assembly; and heating the frit seal to a temperature sufficient to cause the frit to seal.

BRIEF DESCRIPTION OF THE DRAWINGS

For a more complete understanding of the present invention and for further advantages thereof, reference is made to the following Detailed Description of Example Embodiments taken in conjunction with the accompanying drawings, in which.

It is to be noted, however, that the appended drawings illustrate only typical embodiments of this invention and are therefore not to be considered limiting of its scope, for the invention may admit to other equally effective embodiments.

DETAILED DESCRIPTION OF EXAMPLE EMBODIMENTS

Figure 1:
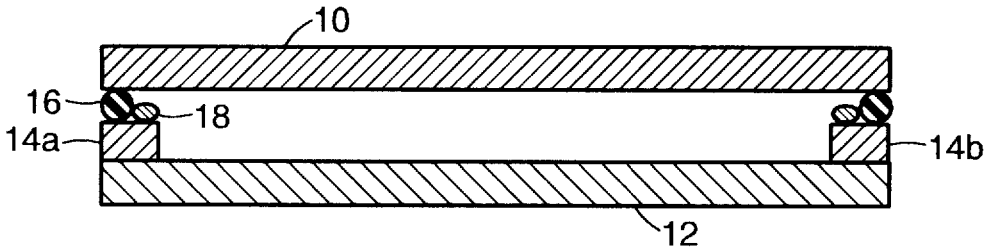
FIG. 1 is a side view of an embodiment of the present invention.

Referring to FIG. 1, a FED is seen comprising a faceplate 10 and a cathode member 12. In the embodiment shown, the cathode member 12 is formed integrally with the backplate, as in, for example, U.S. Pat. No. 5,391,259, incorporated herein by reference. According to alternative embodiments (not shown), the cathode member is separate from and surrounded by the backplate.

According to one embodiment of the invention, either type of FED is made according to a process comprising: aligning the faceplate 10 and the cathode member 12; disposing an adhesive 16 between the faceplate 10 and the cathode member 12; pressing the faceplate 10 and the backplate together; disposing a frit seal 18 between the faceplate 10 and the backplate; and heating the frit seal 18 to a temperature sufficient to cause the frit to seal. According to a more specific embodiment, said pressing occurs during said aligning.

Figure 2:
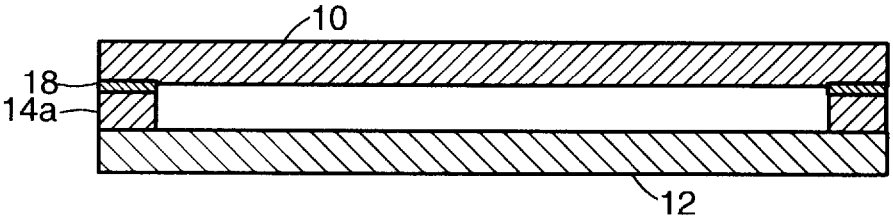
FIG. 2 is a side view of an embodiment of the present invention.

According to another embodiment, said heating causes the adhesive 16 to be removed, and in one specific embodiment, the adhesive 16 is melted from between the faceplate 10 and the cathode member 12, at least to a level that allows frit 18 to contact both the cathode member assembly 12, 14*a*–14*b* and the faceplate 10. See FIG. 2.

It should be noted that in the illustrated embodiment, cathode member 12 is separated from faceplate 10 by spacers 14*a* and 14*b*, which are made of a glass similar to the glass forming the backplate. Like the backplate, faceplate 10 is made of glass according to some embodiments. Acceptable glasses for faceplate 10 and cathode member assembly 12, 14*a*–14*b* include: Corning 7059, 1737, and soda-lime-silica.

It should be noted that in alternative embodiments, the cathode member assembly comprises no spacers 14*a* and 14*b*, and comprises simply a backplate with a cathode assembly formed thereon, as seen in, for example, U.S. Pat. No. 5,329,207, incorporated herein by reference.

Figure 3:
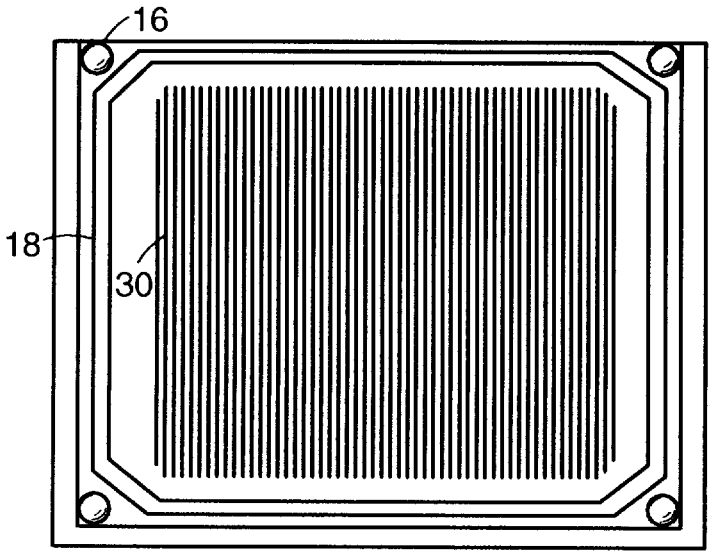
FIG. 3 is a top view of an embodiment of the present invention.

Referring now to FIG. 3, which is a top view of an example embodiment of the present invention, the adhesive 16 is isolated from the cathode 30 which is surrounded by frit seal 18. Also, according to the illustrated embodiment, the adhesive 16 is placed in discrete locations around the frit seal 18, although according to an alternative embodiment, the adhesive 16 is placed in a continuous strip (not shown) around the frit seal 18.

According to still a further embodiment, said pressing causes a cold solder joint to form between the faceplate 10 and the cathode member assembly 12, 14*a*–14*b*, wherein the cold solder joint effectuates a seal due to the composition of adhesive 16. For example, acceptable adhesives which form a cold solder joint include indium, lead, tin, silver, cadmium, and compounds and alloys thereof. Some such materials require heating in order to become wet to glass.

According to another embodiment, removal of the adhesive 16 from between the faceplate 10 and the cathode member assembly 12, 14*a*–14*b* (FIGS. 1 and 2) comprises reduction. According to alternative embodiments, the removal of adhesive 16 is conducted in an oxygen-containing atmosphere, and the adhesive 16 comprises an organic material, and the removal comprises oxidation of the organic material. Examples of acceptable organic adhesives include: corn protein (for example Zein), polyvinyl alcohol, acryloid material (for example Rolm & Haas B66 and B72).

In some embodiments, said disposing an adhesive 16 comprises placement of the adhesive 16 on the faceplate 10 before said pressing, while in other embodiments, said disposing an adhesive 16 comprises placement of the adhesive 16 on the cathode member assembly 12, 14*a*–14*b* before said pressing. The disposing of adhesive 16 comprises, in one example embodiment, pressing adhesive material (for example, indium, having a thickness of about 0.03 inches) onto either cathode member assembly 12,

14*a*–14*b* or faceplate 10. According to an alternative embodiment, said disposing an adhesive 16 comprises extrusion of an adhesive 16 on either the faceplate 10 or the cathode member assembly 12, 14*a*–14*b*.

It will be noted that in further alternative embodiments, said pressing the faceplate 10 and the cathode member assembly 12, 14*a*–14*b* together occurs before said disposing a frit seal 18 between the faceplate 10 and the cathode member assembly 12, 14*a*–14*b* or after said disposing a frit seal 18 between the faceplate 10 and the cathode member assembly 12, 14*a*–14*b*.

What is claimed is:

1. A process for making a field emission display comprising:

aligning a faceplate with phosphor pixels and a cathode member having a plurality of electron emitters;

providing an adhesive between the faceplate and the cathode member;

pressing the faceplate and the cathode member together to hold together the faceplate and cathode member;

providing a sealing material between the faceplate and the cathode member; and heating the sealing material to a temperature sufficient to cause the sealing material to seal the faceplate and the cathode member such that there is a vacuum therebetween.

2. The process of claim 1, wherein the sealing material includes frit.

3. A process for assembly of a FED wherein the FED comprises a faceplate and a cathode member, the process comprising:

aligning the faceplate and the cathode member;

disposing an adhesive between the faceplate and the cathode member;

pressing the faceplate and the cathode member together;

disposing a frit between the faceplate and the cathode member; and heating the frit to a temperature sufficient to cause the frit to seal the faceplate and the cathode member.

4. A process as in claim 3 wherein said pressing occurs during said aligning.

5. A process as in claim 3 wherein said heating causes the adhesive to be removed.

6. A process as in claim 3 wherein said disposing an adhesive comprises placement of the adhesive on the faceplate before said pressing.

7. A process as in claim 3 wherein said disposing an adhesive comprises placement of the adhesive on the cathode member before said pressing.

8. A process as in claim 3 wherein said heating occurs in an evacuated space.

9. A process as in claim 3 wherein said pressing the faceplate and the cathode member together occurs before said disposing a frit.

10. A process as in claim 3 wherein said pressing the faceplate and the cathode member together occurs after said disposing a frit.

11. A process as in claim 3 wherein the cathode assembly is integrally formed with a backplate.

12. The process of claim 3, wherein the pressing and aligning are done at the same time.

13. The process of claim 3, wherein the heating is done such that there is a vacuum between the faceplate and cathode member.

14. The process of claim 3, wherein the cathode member includes a spacer, wherein the disposing includes disposing the adhesive between the faceplate and the spacer.

15. The process of claim 14, wherein disposing the frit includes disposing the frit between the faceplate and the spacer.

16. A process as in claim 3 further comprising reducing the adhesive from between the faceplate and the cathode member by oxidizing the adhesives.

17. A process as in claim 16 wherein said adhesive consists of an organic material chosen from a group consisting of: corn protein, polyvinyl alcohol, and acryloid.

18. A process as in claim 3 wherein said disposing an adhesive comprises pressing adhesive material.

19. A process as in claim 18 wherein said adhesive material comprises indium having a thickness of about 0.03 inches.

20. A process as in claim 1 wherein said disposing an adhesive comprises extrusion of an adhesive on one of the faceplate and the cathode member.

21. A process as in claim 20 wherein said extrusion comprises extrusion of a cold solder material.

22. A process as in claim 21 wherein said cold solder material comprises a material chosen from a group consisting of: indium, lead, tin, silver, cadmium, their compounds, and their alloys.

23. A process as in claim 20 wherein said extrusion comprises extrusion of an organic binder.

24. A process as in claim 23 wherein said organic binder comprises an organic material chosen from a group consisting of: corn protein, polyvinyl alcohol, and acryloid.

25. A process as in claim 3 further comprising melting the adhesive from between the faceplate and the cathode member.

26. A process as in claim 25 wherein the adhesive material can form a cold solder joint and said pressing causes a cold solder joint to form between the faceplate and the cathode member.

27. A process as in claim 26 wherein said adhesive consists of a material chosen from a group consisting of: indium, lead, tin, silver, cadmium, their compounds, and their alloys.

28. A process as in claim 27 wherein said adhesive comprises indium.

29. A process as in claim 25 further comprising isolating the adhesive from a cathode.

30. A process as in claim 29 wherein said isolating comprises placing the adhesive outside of the frit seal.

31. A process as in claim 30 wherein said isolating further comprises placing the adhesive in discrete locations around the frit seal.

32. A process as in claim 30 wherein said isolating further comprises placing the adhesive in a continuous strip around the frit seal.

33. A process as in claim 32 wherein the adhesive material can form a cold solder joint and said pressing causes a cold solder joint to form between the faceplate and the cathode member.

34. A process as in 32 wherein said pressing is performed at an elevated temperature.

* * * * *